US008826898B2

(12) United States Patent
Armstrong et al.

(10) Patent No.: US 8,826,898 B2
(45) Date of Patent: Sep. 9, 2014

(54) METAL RACK FOR AN OVEN APPLIANCE

(75) Inventors: James Lee Armstrong, Louisville, KY (US); Joshua Stephen Wiseman, Elizabethtown, KY (US)

(73) Assignee: General Electric Company, Schenectady, NY (US)

( * ) Notice: Subject to any disclaimer, the term of this patent is extended or adjusted under 35 U.S.C. 154(b) by 53 days.

(21) Appl. No.: 13/326,526

(22) Filed: Dec. 15, 2011

(65) Prior Publication Data

US 2013/0118470 A1 May 16, 2013

Related U.S. Application Data

(60) Provisional application No. 61/558,322, filed on Nov. 10, 2011.

(51) Int. Cl.
*F24C 15/16* (2006.01)

(52) U.S. Cl.
CPC ..... *F24C 15/16* (2013.01)
USPC ..... 126/19 R; 126/337 R; 126/339; 211/135; 211/153

(58) Field of Classification Search
CPC ..... F24C 15/16; B23P 19/04; B23P 25/00; A47J 37/06; B21D 47/04; E04C 2/421; E04C 3/083; E04C 3/09; E04C 2003/0473; E04C 2003/0434; E04C 2003/0452; E04C 2003/046; E04C 2003/0413
USPC ..... 126/19 R, 21 A, 21 R, 1 R, 337 R, 339; 29/6.1, 428; 211/71.01, 134, 153, 135
See application file for complete search history.

(56) References Cited

U.S. PATENT DOCUMENTS

| | | | | |
|---|---|---|---|---|
| 434,970 | A * | 8/1890 | Allyn | 126/339 |
| 1,259,210 | A * | 3/1918 | Clark | 52/799.1 |
| 2,076,099 | A * | 4/1937 | Smith et al. | 211/153 |
| 4,355,570 | A * | 10/1982 | Martin et al. | 99/446 |
| 4,391,073 | A * | 7/1983 | Mollenkopf et al. | 52/241 |
| 6,330,777 | B1 * | 12/2001 | Padley | 52/670 |
| 7,290,320 | B2 | 11/2007 | Blankenship | |
| 2009/0250420 | A1 * | 10/2009 | Martin et al. | 211/134 |
| 2010/0084355 | A1 * | 4/2010 | Parks et al. | 211/181.1 |

* cited by examiner

*Primary Examiner* — Kenneth Rinehart
*Assistant Examiner* — Bao D Nguyen
(74) *Attorney, Agent, or Firm* — Dority & Manning, P.A.

(57) ABSTRACT

An oven rack constructed from an expanded or punched metal is provided. The oven rack can be coated with one or more coatings to e.g., protect the metal from discoloration or damage, and/or to provide certain properties to the surface of the rack that may be desirable for cooking operations. An oven appliance incorporating such an oven rack is also provided.

20 Claims, 8 Drawing Sheets

FIG. –1–

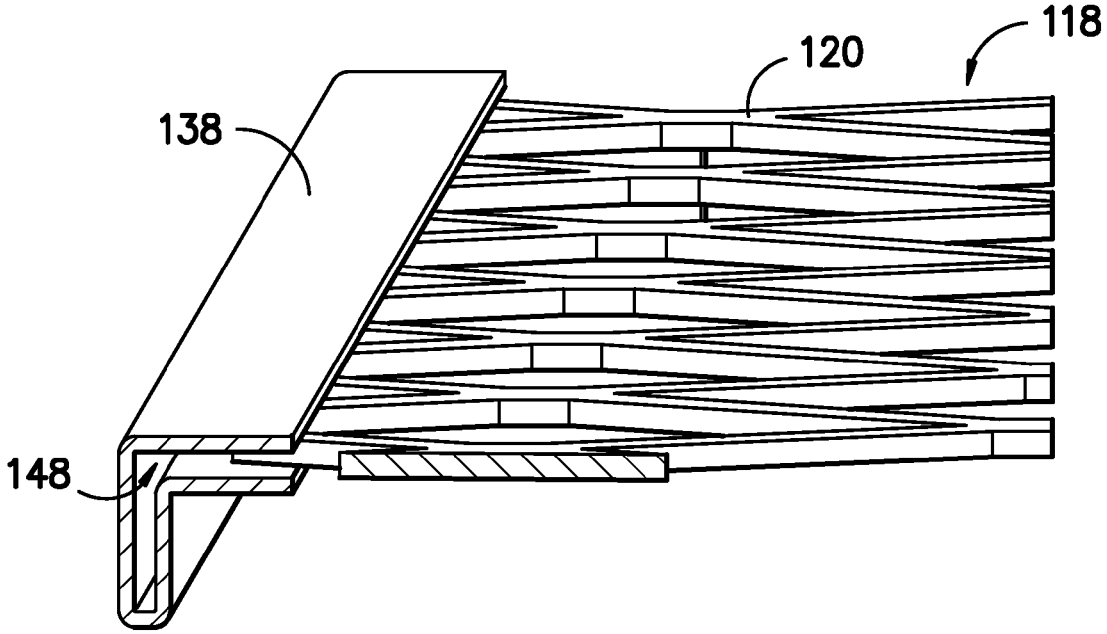
FIG. –5–
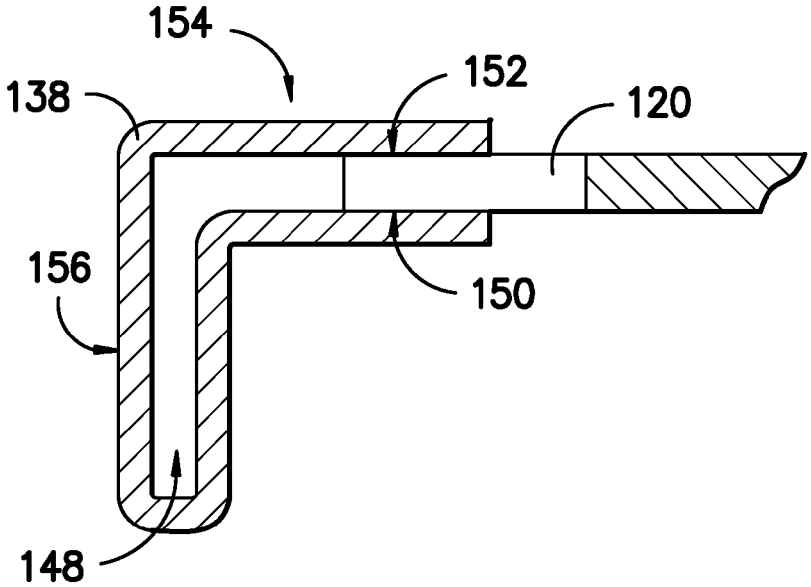
FIG. –6–

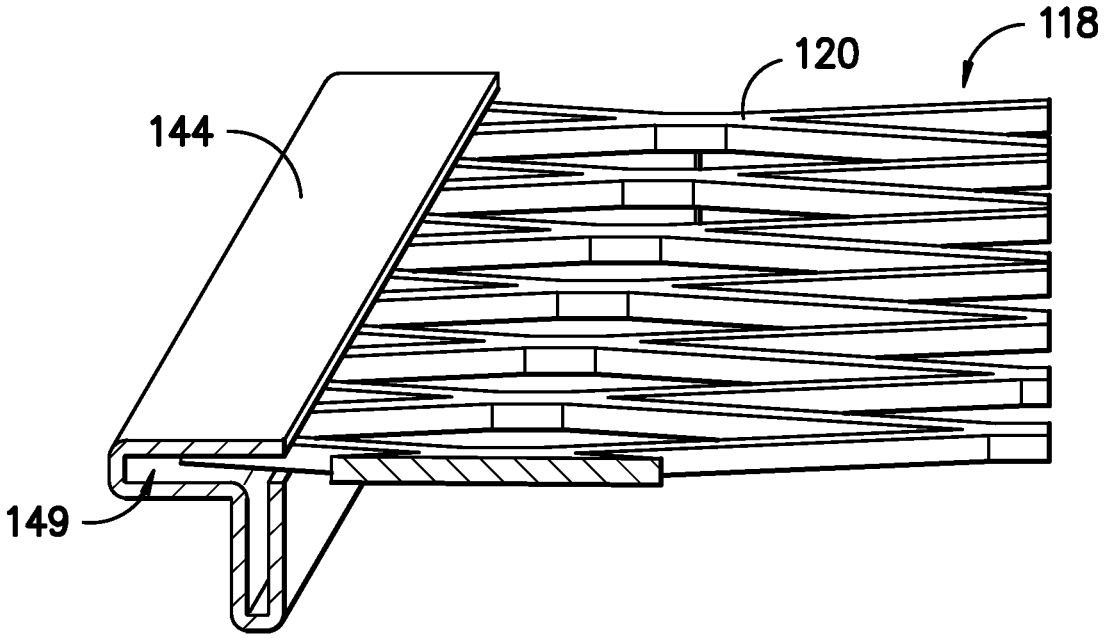
FIG. –7–
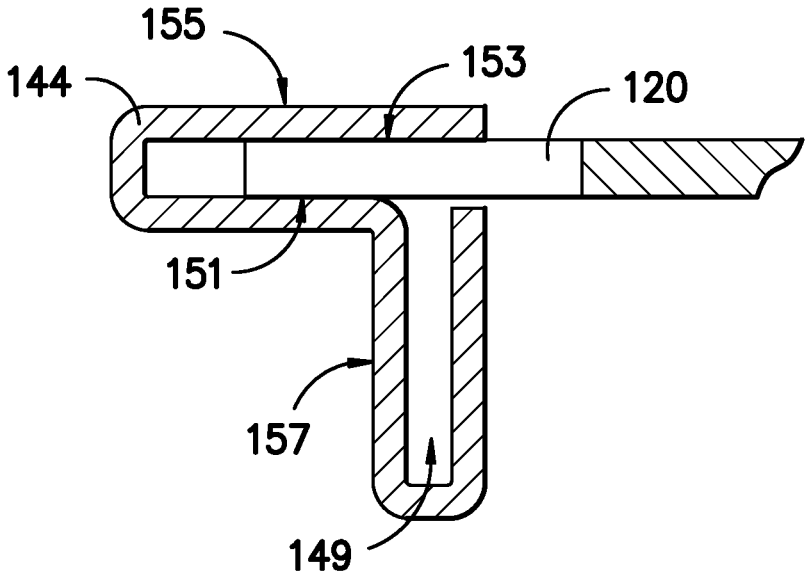
FIG. –8–

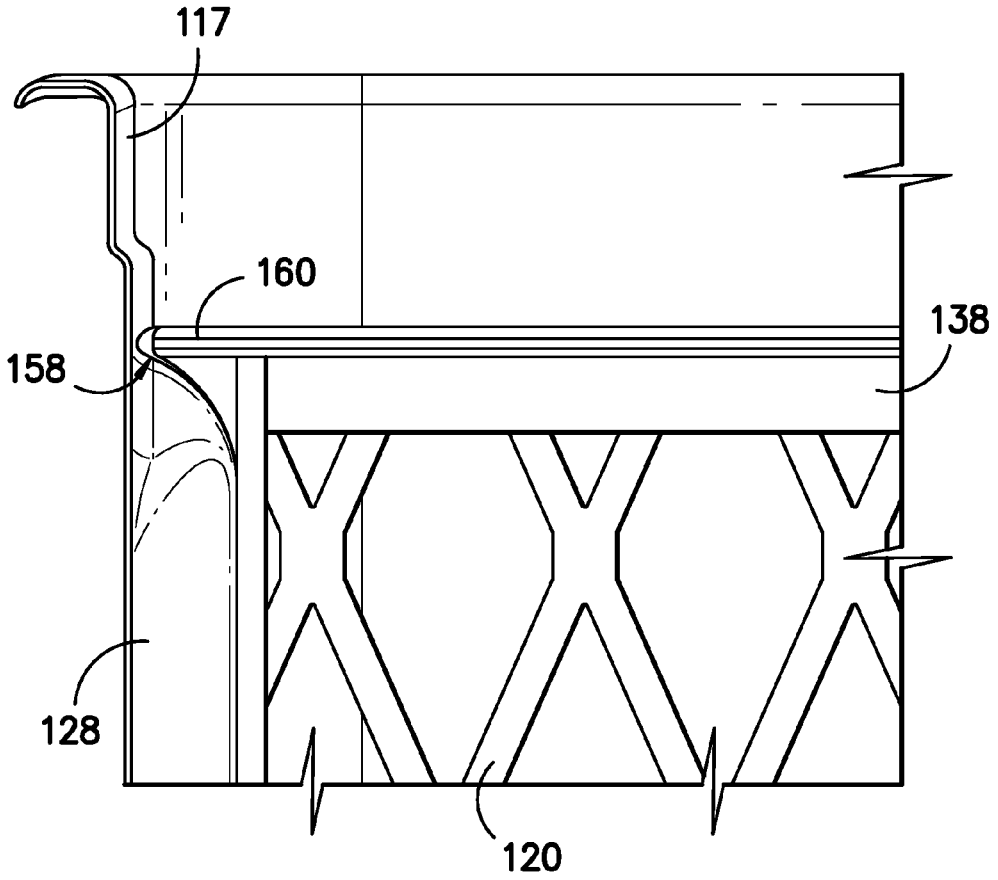
FIG. –9–

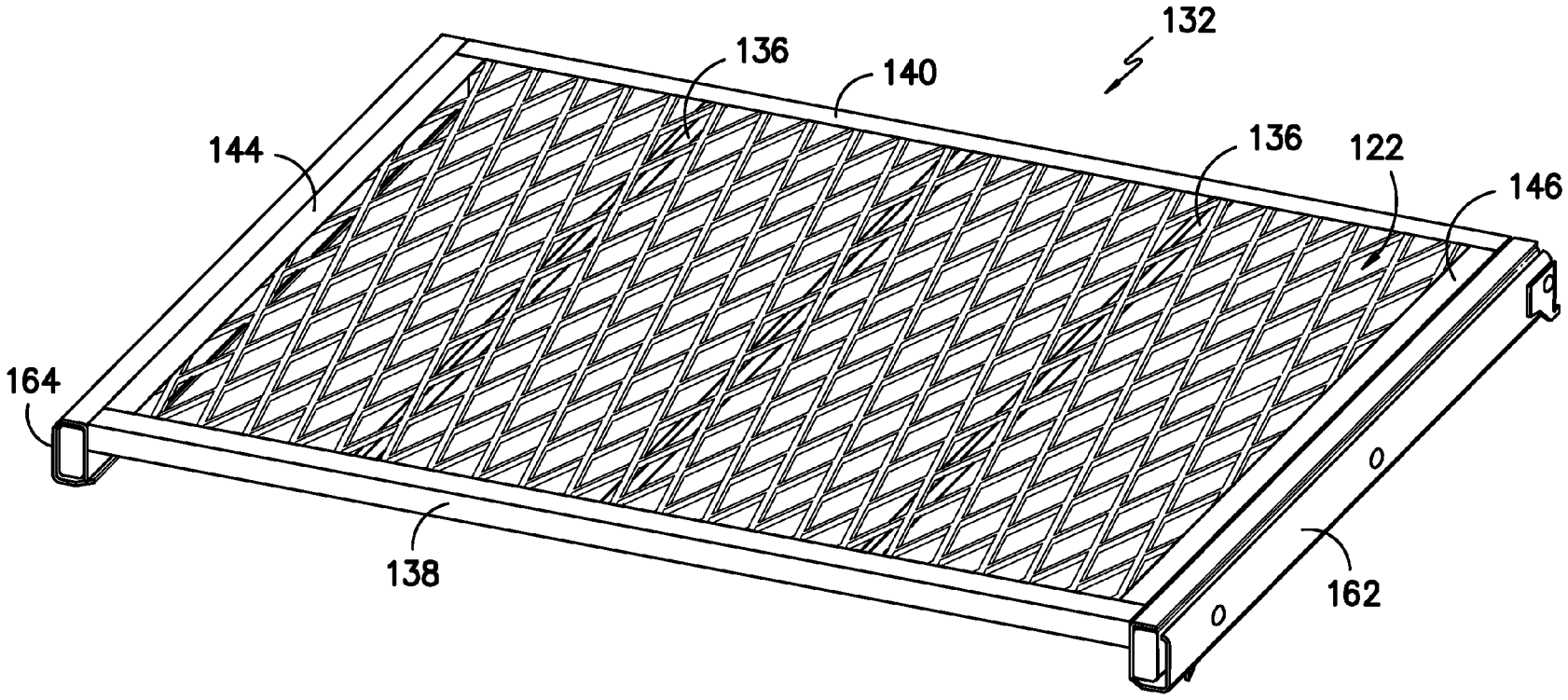
FIG. —10—

METAL RACK FOR AN OVEN APPLIANCE

FIELD OF THE INVENTION

The subject matter of the present invention relates generally to rack for an oven appliance that is constructed from metal.

BACKGROUND OF THE INVENTION

Conventional ovens are typically equipped with one or more racks for the receipt of utensils containing food items for cooking. For convenience, the racks are usually extendable by sliding in and out of the oven cavity. Such movement e.g., can allow for more easily removing or inserting items into the oven or for allowing an item to cool before being removed from the rack. The racks may also be removable for cleaning and/or height adjustment.

A common construction used for oven racks utilizes elongated rods that are e.g., welded together. The rods are configured in a grid-like manner that allows for the support of food or a cooking utensil. Open spaces between the rods also allow for a free flow of air that promotes more uniform heating and proper cooking. Unfortunately, the manufacturing process for such racks can be complex and time consuming. The rods must be provided at appropriate lengths and shapes and then welded together in the configuration desired.

Another challenge in the design and construction of oven racks relates to the cleaning and appearance of the racks. During use, the racks are exposed to very high temperatures during both the cooking and cleaning process. Depending on the material of construction, the high temperatures can discolor the racks in a manner that is displeasing to the user. Additionally, food may be deposited on the racks during use. Again, depending on the material of construction, such deposits can be difficult to remove during cleaning and/or may leave an undesirable discoloration even after cleaning.

Accordingly, an oven rack that can provide an alternative to conventional rack constructions would be useful. More specifically, an oven rack that can be manufactured without the elongated rod construction of conventional designs would be useful. A rack that can also provide for the even distribution of heat and flow of air through the rack during cooking would be beneficial. Such a rack that can also be provided with one or more coatings for protection of the rack would also be useful. An oven containing one or more such racks would also be beneficial.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides a rack for an oven appliance. The rack includes a sheet of metal having a plurality of openings spaced over the sheet. The sheet has multiple peripheral edges. A frame is attached to one or more peripheral edges of the sheet of metal. A brace is positioned adjacent to the sheet of metal, connected with the frame, and extends between at least two of the peripheral edges of the sheet.

In another aspect of the present invention, a method for manufacturing an oven rack is provided. The method includes the steps of providing an expanded metal sheet comprising iron; cutting the expanded metal sheet into a predetermined shape for the oven rack; providing a frame for attachment to the periphery of the expanded metal sheet; and, joining the frame to the expanded metal sheet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 5 illustrates a detail of an edge or side of the exemplary oven rack of FIG. 3.

FIG. 6 is a cross-sectional view of the edge or side of the exemplary oven rack of FIG. 3.

FIG. 7 illustrates a detail of another edge or side of the exemplary oven rack of FIG. 3.

FIG. 8 is another cross-sectional view of an edge or side of the exemplary oven rack of FIG. 3.

FIG. 9 is a top down view of a portion of the front end of the exemplary oven rack of FIG. 3.

Figure 1:
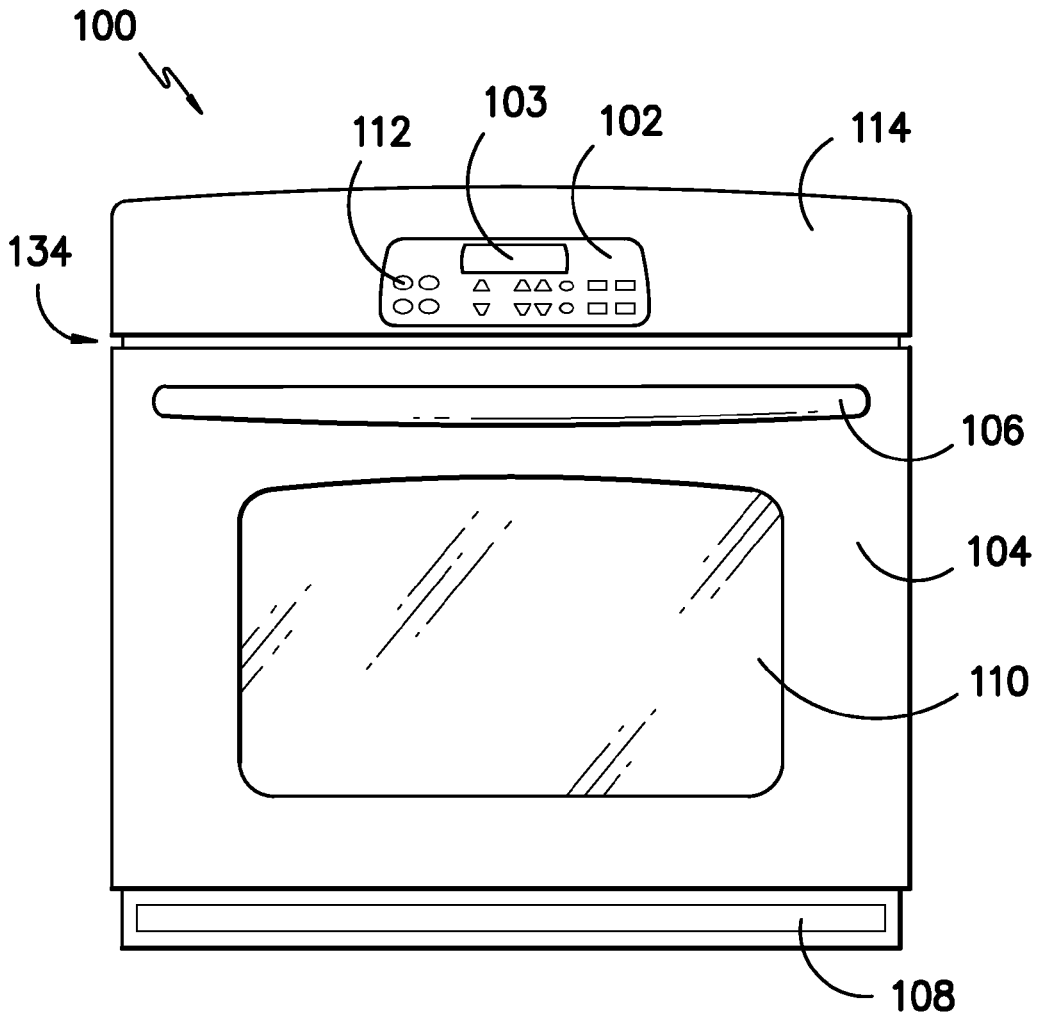
FIG. 1 provides a front view of an exemplary embodiment of an oven of the present invention.

Another exemplary embodiment of an oven rack of the present invention is illustrated with a perspective view in FIG. 10.

DETAILED DESCRIPTION OF THE INVENTION

The present invention relates to an oven rack constructed from an expanded or punched metal. The oven rack can be coated with one or more coatings to e.g., protect the metal from discoloration or damage, and/or to provide certain properties to the surface of the rack that may be desirable for cooking operations. The present invention also includes an oven appliance incorporating such an oven rack.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
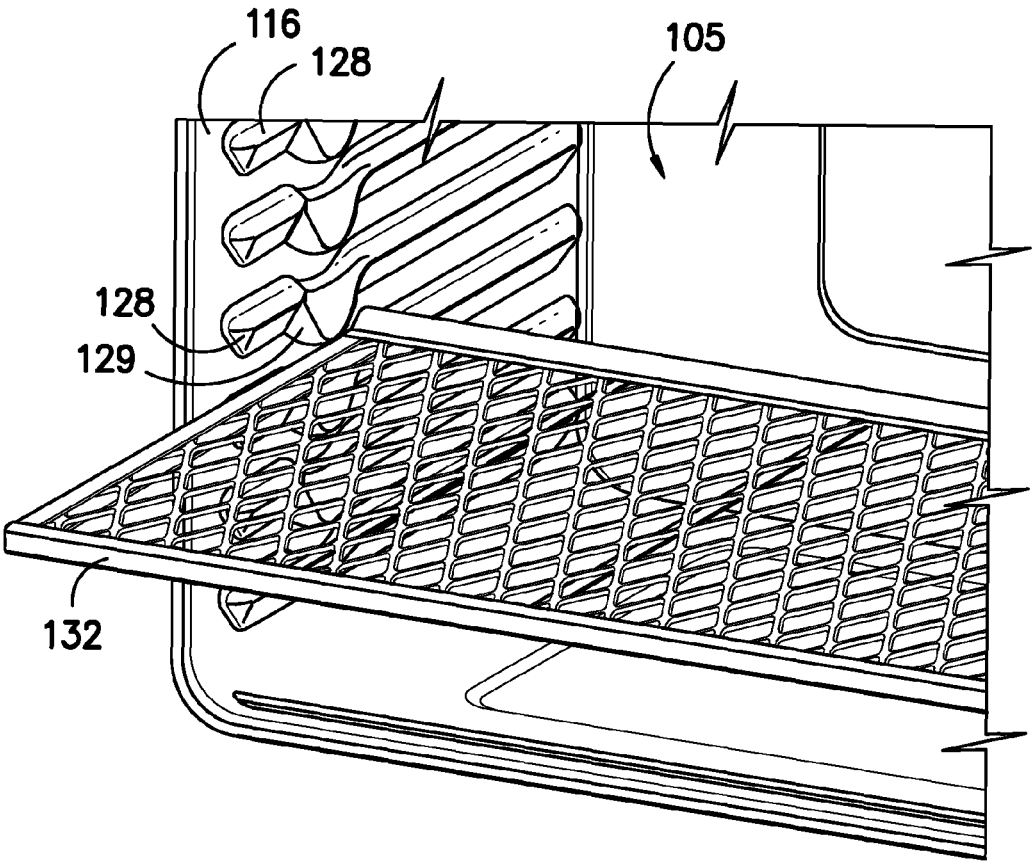
FIG. 2 provides a partial perspective view of the oven cavity of FIG. 1 with an exemplary embodiment of an oven rack of the present invention extending from the cavity.

Referring to FIG. 1, an exemplary embodiment of an oven 100 according to the present invention is shown. FIG. 1 provides a front view of oven 100 while FIG. 2 provides a partial perspective view into the cooking chamber or cavity 105. Oven 100 includes a door 104 with handle 106 that provides for opening and closing access to a cooking chamber 105. A user of the appliance 100 can place a variety of different items to be cooked in chamber 105.

One or more heating elements (not shown) positioned at the top of chamber 105 provide heat for cooking. Such heating element(s) can be gas, electric, microwave, or a combination thereof. Other heating elements could be located at the bottom of chamber 105 as well. A window 110 on door 104 allows the user to view e.g., food items during the cooking process. For purposes of cooling, vent 108 allows for an inflow of ambient air into a ventilation system while vent 134 allow for the outflow of such air after it has been heated by oven 100.

Oven 100 includes a user interface 102 having a display 103 positioned on top panel 114 with a variety of controls 112. Interface 102 allows the user to select various options for the operation of oven 100 including e.g., temperature, time, and/or various cooking and cleaning cycles. Operation of oven appliance 100 can be regulated by a controller (not shown) that is operatively coupled i.e., in communication with, user interface panel 102, heating element(s), and other components of oven 100 as will be further described.

For example, in response to user manipulation of the user interface panel 102, the controller can operate heating element(s). The controller can receive measurements from a temperature sensor (not shown) placed in cooking chamber 105 and e.g., provide a temperature indication to the user with display 103. By way of example, the controller may include a memory and one or more processing devices such as microprocessors, CPUs or the like, such as general or special purpose microprocessors operable to execute programming instructions or micro-control code associated with operation of appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout appliance 100. In the illustrated embodiment, the controller may be located under or next to the user interface 102 otherwise within top panel 114. In such an embodiment, input/output ("I/O") signals are routed between the controller and various operational components of appliance 100 such as heating element(s), controls 112, display 103, sensor(s), alarms, and/or other components as may be provided. In one embodiment, the user interface panel 102 may represent a general purpose I/O ("GPIO") device or functional block.

Although shown with touch type controls 112, it should be understood that controls 112 and the configuration of appliance 100 shown in FIG. 1 is provided by way of example only. More specifically, user interface 102 may include various input components, such as one or more of a variety of electrical, mechanical or electro-mechanical input devices including rotary dials, push buttons, and touch pads. The user interface 102 may include other display components, such as a digital or analog display device designed to provide operational feedback to a user. The user interface 102 may be in communication with the controller via one or more signal lines or shared communication busses. Also, oven 100 is shown as a wall oven but the present invention could also be used with other appliances such as e.g., a stand-alone oven, an oven with a stove-top, and other configurations as well.

FIG. 2 also illustrates an exemplary embodiment of an oven rack 132 of the present invention that, as shown, is partially extending from the cavity 105 of oven 100. Interior wall 116 provides a plurality of guides 128 that, in conjunction with guides placed on an opposing interior wall (not shown), provide for the positioning of rack 132 at various levels within oven 100. Such adjustability allows the user of the appliance to accommodate differently sized cooking utensils and/or food items as well as determine the placement of a food item relative to one or more heating elements in cavity 105. Additionally, for purposes of convenience and accessibility, rack 132 can be slid in and out of cavity 105 along guides 128. Although only one rack 132 is shown, multiple racks 132 may be employed with oven 100.

Figure 3:
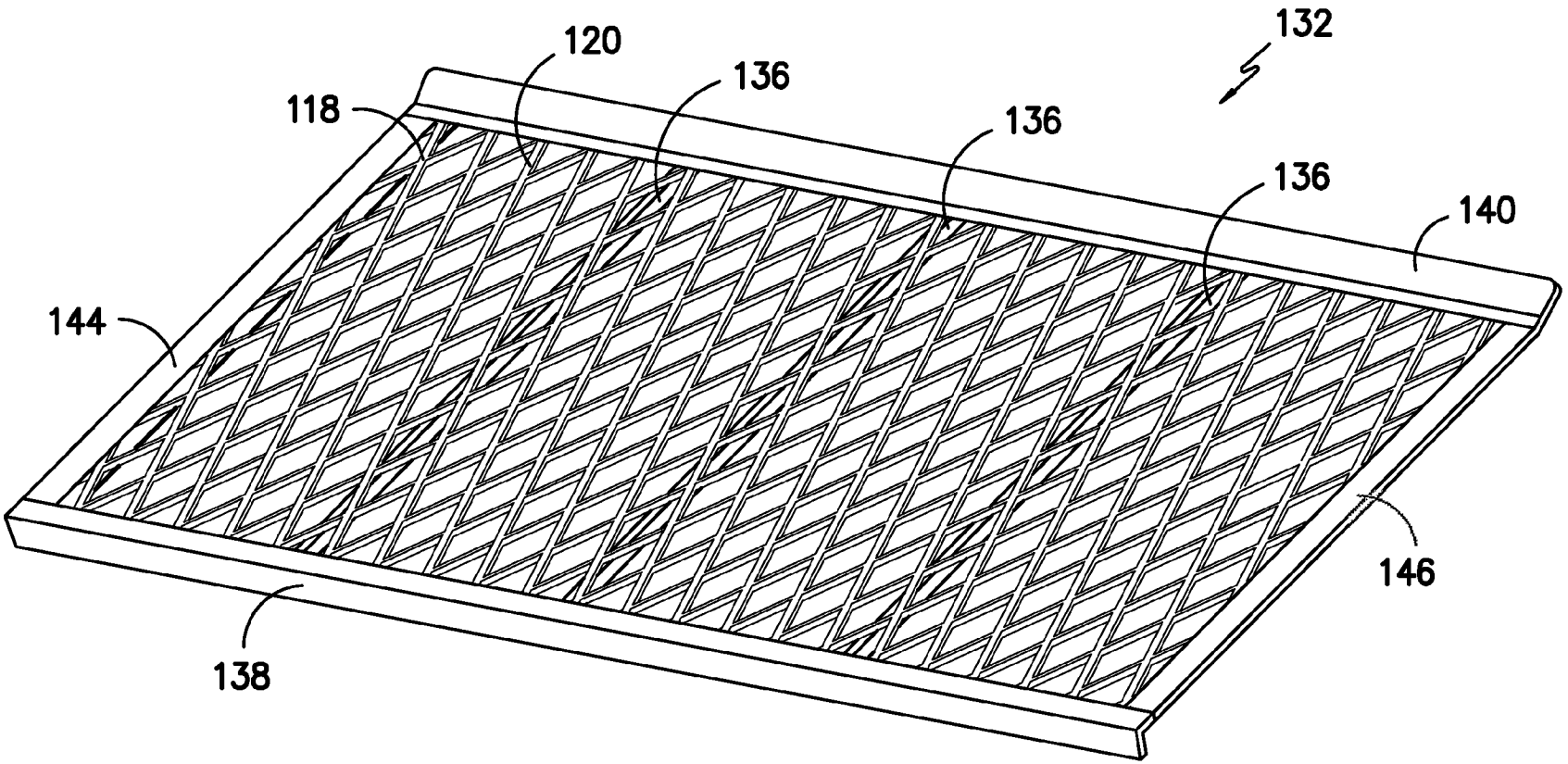
FIG. 3 is a perspective view of an exemplary embodiment of an oven rack of the present invention.
Figure 4:
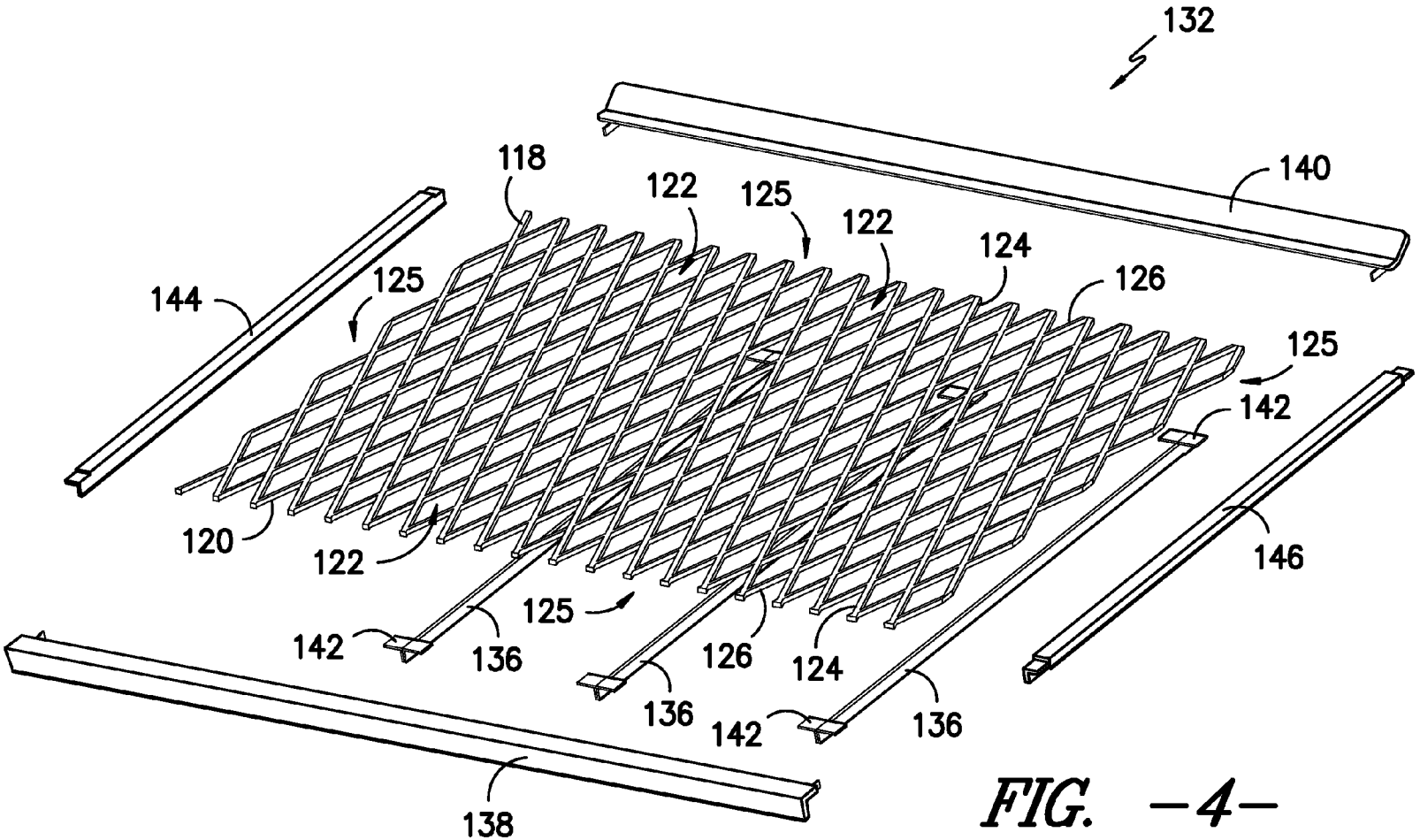
FIG. 4 provides an exploded view of the exemplary embodiment of FIG. 3.

FIG. 3 provides a perspective view of the exemplary oven rack 132, while FIG. 4 provides an exploded, perspective view of rack 132. Rack 132 includes a shelf structure 118 that, for this exemplary embodiment, is constructed from expanded metal sheet 120. In general, the expanded metal sheet 120 is created by e.g., subjecting a closed sheet of metal to a process that shears and stretches the metal to create a plurality of openings 122 within a grate or lattice of the expanded metal. While a variety of different shapes can be created, the plurality of openings 122 typically have a diamond configuration created by the lattice of parallel bars 124 and 126. The sheet of expanded metal is then cut into e.g., a square, rectangle, or other shape as may be desired for an oven rack. While a variety of different metals may be used, preferably the expanded metal is in the range of about 80 to 99.9 percent iron.

Proper cooking operations depend on the flow of radiant energy and the movement of heated air within cavity 105. In order to facilitate both radiant and convective effects, the expanded metal 120 of rack 132 must include an adequate amount of open area or else cooking operations will be adversely affected because the radiant and convective energy sources will be blocked. This need is particularly acute where multiple racks 132 are used in oven cavity 105. Accordingly, preferably the amount of open area (i.e. the amount of area representing open spaces or holes in rack 132 versus the amount of blocked space represented by the metal making up metal sheet 120) is equal to or greater than about 50 percent and, still even more preferably, equal to or greater than about 80 percent.

In order to enhance its structural stiffness, rack 132 is provided with a plurality of braces 136 that extend from a front frame portion 138 to a rear frame portion 140. The braces 136 are positioned adjacent—i.e., immediately below—expanded metal 120 to provide support thereto. For this exemplary embodiment, each brace 136 includes tabs 142 at each end of brace 136. Tabs 142 can be used to affix brace 136 to front frame portion 138 and rear frame portion 140. For example, tabs 142 can be used to weld braces 136 to portions 138 and 140.

For this exemplary embodiment, braces 136 extend from the front frame portion 138 to rear frame portion 140 as shown. However, other configurations may be used as well. For example, braces 136 could extend between side frame portions 144 and 146 in a manner perpendicular to what is shown in FIGS. 3 and 4. Combinations where braces 136 extend between all portions 138, 140, 144, and 146 could also be used. Additionally, a different number of braces 136 other than what is shown may be employed depending upon the amount of stiffness desired for rack 132.

Frame portions 138, 140, 144, and 146 also provide additional stiffness for support of the expanded metal 120 of rack 132. Such stiffness is provided against both torsional and bending forces that may act upon rack 132 during cooking operations. Referring now to FIGS. 5 and 6, the construction of frame portion 138 is illustrated and serves as an example of how other frame portions may be constructed as well. As shown, frame portion 138 is L-shaped and defines a slot 148 into which one of several peripheral edges 125 (FIG. 4) of the expanded metal 120 may be received. The L-shaped frame portion includes legs 154 and 156. In one exemplary method of construction, leg 154 can be welded to expanded metal 120 using e.g., spot welds at locations 150 and 152. Leg 156 also provides an edge by which the user may withdraw or pull rack 132 from cavity 105 of oven 100.

FIGS. 7 and 8 show the construction for frame portion 144, it being understood that a similar construction could be used for frame portion 146. Frame portion 144 is L-shaped as with frame portion 138 but is oriented differently to accommodate the insertion of rack 132 between guides 128 on opposing interior walls 116 of cavity 105 (FIG. 2). Frame portion 144 defines a slot 149 into which one of several peripheral edges 125 (FIG. 4) of the expanded metal 120 may be received. The L-shaped frame portion includes legs 155 and 157. In one exemplary method of construction, leg 155 can be welded to expanded metal 120 using e.g., spot welds at locations 151 and 153. Leg 157 provides for structural support and also helps orient rack 132 along guides 128.

A top view of one edge of rack 132 is shown in FIG. 9. For this embodiment, front frame portion 138 includes an extension 160 that projects past side frame portion 146. A similar extension (not shown) can be provided for the other side of rack 132 that projects past side frame portion 144. A groove 158 is defined by interior wall 117 at the end of guide 128. A similar groove can be provided on the opposing interior wall 116. Groove 158 is configured for mating receipt of extension 160 along each side of front frame portion 138. Extension 160, therefore, provides a stopping point when the consumer pushes rack 132 into cavity 105 to protect the rear wall of cavity 105 and the rear frame portion 140 from damage. Other configurations to protect the rear wall of cavity 105 may be employed as well.

As shown in FIGS. 2 and 3, for this exemplary embodiment, rear frame portion 140 of rack 132 is angled relative to side portions 144 and 146 and serves as a catch or stop to delimit the movement of rack 132 out of the oven cavity. More specifically, when a user pulls rack 132 out of cavity 105, rear frame portion 140 makes contact with a protuberance 129 in guide 128. This contact serves to stop rack 132 from further movement out of oven 100. However, by lifting the front of rack 132 up slightly, rack 132 can still be removed from oven cavity 105, which allows cleaning and/or repositioning of rack 132 as desired.

FIG. 10 illustrates another exemplary embodiment of rack 132. For this embodiment, rack 132 is equipped with a pair of drawer slides 162 and 164 that allow for the movement of rack 132 into, and out of, cavity 105. More specifically, slides 162 and 164 can be equipped with bearings and other features that facilitate the sliding movement of rack 132 relative to interior walls 116 and 117 to which slides 162 and 164 are mounted. Other configurations and/or mechanisms for the movement of rack 132 into, and out of, oven 100 may be employed as well.

The above construction for rack 132 is by way of example only. Using the teachings disclosed herein, one of skill in the art will understand that other configurations can be employed to support expanded metal 120 and provide the stiffness necessary for oven applications. Additionally, as opposed to expanded metal 120, a punched metal could also be used with rack 132 in alternative embodiments of the invention. More specifically, a sheet of metal could be punched to provide openings of various shapes. The resulting sheet could then be supported by a frame and/or braces as described herein.

Rack 132 may be provided with a variety of different coatings. Such coatings can e.g., serve to protect expanded metal 120 from damage and discoloration that can be caused by the extreme temperatures or other conditions that can occur in cavity 105. Such coatings could also provide protection from foods spilled or deposited onto the rack 132 during use. By way of example, such coatings could be constructed from an enamel. Alternatively, a ceramic coating could be applied. In still another embodiment, a nickel coating could be used. Other coatings can be used as well. Non-stick coatings may also be employed.

By way of example, rack 132 could be cleaned by acid washing and then sprayed with one or more powder coatings using an electrostatic coating process. Alternatively, a wet spray method may be employed to coat rack 132 using wet spray, electrostatic wet spray, wet flow coating, wet dip and/or electrophoretic deposition. The wet coating processes can be single step or multiple step process followed by one or more heating steps.

Although the above exemplary embodiment has been described using a single metal sheet 120 that is connected with the frame portions along its peripheral edges, using the teachings disclosed herein it will be understood that rack 132 could be constructed using one or more metal sheets cut into shapes as desired and positioned with the frame portions to provide the desired rack configuration. For example, rack 132 could be constructed from two or three metal sheets placed side-by-side and joined to the frame portions. Braces 136 could be located adjacent or directly under the seams where such metal sheets meet. The sheets could be welded or otherwise joined to the braces to provide structural support and rigidity.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A rack for an oven appliance, the rack comprising:

a metal sheet comprising a plurality of openings spaced over the metal sheet between multiple peripheral edges that are coplanar with the metal sheet;

a frame comprising a pair of L-shaped portions attached along opposing peripheral edges of the metal sheet, each L-shaped portion comprising a pair of legs that are respectively horizontally-oriented and vertically-oriented, each of the pair of legs defining a slot, wherein the opposing peripheral edges of the metal sheet extend into the slot along only the horizontally-oriented leg, and wherein each L-shaped portion is positioned such that the horizontally-oriented leg extends further away from a center of the metal sheet than a vertical plane associated with the vertically-oriented leg, such that the respective peripheral edge of the metal sheet that extends along the horizontally-oriented leg of each L-shaped portion extends beyond the vertically-oriented leg;

a brace positioned adjacent to the metal sheet, connected with the frame, and extending between at least two of the multiple peripheral edges of the metal sheet.

2. The rack for an oven appliance as in claim 1, wherein for each L-shaped portion the pair of legs are orthogonal to each other.

3. The rack for an oven appliance as in claim 2, wherein the oven appliance includes guides positioned along opposing interior walls, wherein each L-shaped portion is configured for receipt of one of the guides between the pair of legs of each L-shaped portion.

4. The rack for an oven appliance as in claim 1, wherein the metal sheet comprises an expanded metal.

5. The rack for an oven appliance as in claim 4, wherein the openings of the metal sheet are diamond shaped.

6. The rack for an oven appliance as in claim 1, wherein the frame comprises multiple frame portions, each of the frame portions being attached to at least one peripheral edge of the metal sheet.

7. The rack for an oven appliance as in claim 1, wherein the frame portions and the metal sheet are welded together.

8. The rack for an oven appliance as in claim 1, wherein the frame comprises multiple frame portions, and wherein each frame portion is L-shaped and defines a slot into which at least one peripheral edge is received.

9. The rack for an oven appliance as in claim 8, wherein the frame portions and the sheet are welded together.

10. The rack for an oven appliance as in claim 1, wherein the brace includes one or more tabs positioned at opposing ends of the brace, the tabs being connected to the frame.

11. The rack for an oven appliance as in claim 10, wherein the tabs are welded to the frame.

12. The rack for an oven appliance as in claim 1, wherein the frame comprises multiple frame portions, and wherein at least one of the frame portions is angled relative to the other frame portions so as to provide a stop that delimits the sliding movement of the rack within the oven appliance.

13. The rack for an oven appliance as in claim 1, wherein the metal sheet is coated with a metal plating material.

14. The rack for an oven appliance as in claim 1, wherein the metal sheet has an open area of about 80 percent or greater.

15. The rack for an oven appliance as in claim 1, wherein the metal sheet is coated with a non-metallic, ceramic material.

16. An oven comprising the rack of claim 1.

17. A method for manufacturing an oven rack, comprising:

cutting an expanded metal sheet into a predetermined shape for the oven rack, the metal sheet having multiple peripheral edges lying within a plane defined by the metal sheet;

creating a frame for attachment to the periphery of the expanded metal sheet, the frame comprising an L-shaped portion that includes a pair of legs that are respectively horizontally-oriented and vertically-oriented, each of the pair of legs defining a slot; and inserting at least one peripheral edge of the expanded metal sheet into only the slot defined by the horizontally-oriented leg such that the at least one peripheral edge of the expanded metal sheet remains within the plane of the metal sheet and the vertically-oriented leg is positioned beneath the metal sheet, wherein each L-shaped portion is positioned such that the horizontally-oriented leg extends further away from a center of the metal sheet than a vertical plane associated with the vertically-oriented leg.

18. A method for manufacturing an oven rack as in claim 17, further comprising the step of coating the expanded metal sheet with a non-metallic material, a metallic material, or a combination thereof.

19. A rack for an oven appliance, the rack comprising:

a metal sheet having a plurality of openings spaced over the sheet, the sheet having multiple peripheral edges lying within a plane defined by the metal sheet;

a frame attached to at least one peripheral edge of the metal sheet such that the at least one peripheral edge is within the plane of the metal sheet, wherein the frame comprises multiple frame portions, and wherein at least one frame portion is L-shaped and includes a slot defined by a first horizontally-oriented leg and a second vertically-oriented leg, wherein the metal sheet is positioned outside of the second vertically-oriented leg and within a portion of the slot defined by the first horizontally-oriented leg, wherein the L-shaped portion is positioned such that the first horizontally-oriented leg extends further away from a center of the metal sheet than a vertical plane associated with the second vertically-oriented leg, and wherein the portion of the metal sheet positioned within the slot defined by the first horizontally-oriented leg extends beyond the second vertically-oriented leg; and a brace positioned adjacent to the metal sheet, connected with the frame, and extending between at least two of the peripheral edges of the metal sheet.

20. The rack for an oven appliance as in claim 19, wherein the metal sheet comprises an expanded metal.

* * * * *